United States Patent [19]

Murphy

[11] 4,021,880

[45] May 10, 1977

[54] GATE STOP

[76] Inventor: Edward Patrick Murphy, 2994 Knoll Drive, Concord, Calif. 94520

[22] Filed: July 29, 1976

[21] Appl. No.: 709,879

[52] U.S. Cl. ..... 16/82; 292/340

[51] Int. Cl.[2] ..... E05F 5/02

[58] Field of Search ..... 16/82, 83, 86.1, 86.2, 16/49; 292/340, 346

[56] References Cited

UNITED STATES PATENTS

| | | | |
|---|---|---|---|
| 1,245,734 | 11/1917 | Katzenberger | 16/86.1 X |
| 1,388,851 | 8/1921 | Cordes | 16/82 |
| 3,442,543 | 5/1969 | Weyman | 292/340 |
| 3,963,269 | 6/1976 | Rosenberg | 292/346 |

*Primary Examiner*—Werner H. Schroeder

*Assistant Examiner*—Moshe I. Cohen

*Attorney, Agent, or Firm*—Michael D. Nelson

[57] ABSTRACT

An improved gate stop is disclosed comprising a flat plate having a forward first section, a central second section, and a rear third section. A narrow slit is cut through the plate following a path beginning at the junction of the second and third sections near the lower boundary of the plate, extending toward the first section, then upwardly toward the upper boundary of the plate, and then toward the third section, and terminating at the junction of the second and said third sections near the upper boundary of the plate. This slit defines the border of a flap which projects outwardly when the third section is bent perpendicular to the second section.

11 Claims, 4 Drawing Figures

GATE STOP

BACKGROUND OF THE INVENTION

In the majority of the rural homes in the United States, the back yards are enclosed by wooden fences. There are usually one or two gates in these fences to permit access to the other side. The gates are typically hinged to a post on one side and connected to a latching mechanism on the other side. One part of a latch mechanism is attached to the gate, and another part of the mechanism is connected to an adjacent post. Thus, the gate is firmly connected by the latch mechanism to one post and by the hinges to another post. This assures the security of the back yard and prevents the intrusion into the yard by animals and others without releasing the latch mechanism. Ingress and egress from the yard is effected by releasing the latching mechanism and swinging the gate about its hinged axis. Upon passing through the open gate, the gate door is swung back into place and relatched.

A problem develops over a period of time from the impact of the gate closing against the latch mechanism. The momentum of the gate is transferred directly into the latching system. Because of the light weight character of the typical latch mechanism and the impact from the heavy gate, the repeated closure of the gate eventually breaks down the latch mechanism. After this occurs, the momentum of the gate will be transferred through the length of the gate into the hinges. Because the torque effect on the hinges at this time is so great, the gate hinges will eventually be pulled from the post or the gate support resulting in total gate failure.

To overcome this problem, numerous workers in the construction trade have nailed a piece of wood, usually a portion of one of the slats used on the fence, to the post or gate support. This piece of wood would then function as a stopping device which would absorb the shock from the gate during closing. This, however, is only a temporary solution since the use of wood to transfer the gate momentum will not withstand the many impacts over a period of time. Also, the momentum transferred into the wood stop is in turn transferred into the post or gate support via the nails. Repeated use will loosen the nails, thereby causing the wood stopper to ultimately fail.

Other stoppers have been proposed in other areas. For example, U.S. Pat. No. 1,388,851 discloses a stopper for drawers. In that patent, a flat plate is disclosed having a tab extending from one edge of the plate and perpendicular to the plate. The plate is connected to the drawer casing by screws. The tab is used to catch a base plate attached to the back of the drawer wall. The base plate strikes the tab and prevents the complete withdrawal of the drawer from the desk, bureau or table. The use of such stoppers on gates would be an improvement over the wood stopper, but would still have problems. For example, as with the wood stoppers, the momentum of the gate would be transferred through the metal stopper into the screws which are anchored into the post or gate support. With continued use, these screws will be loosened and eventually pulled out of the post or gate support, Also, the metal stoppers would require the use of screws rather than nails. The adaptability of a gate stopper to use nails is an important economic advantage in the construction trade.

Therefore, a need exists for an improved gate stopper which is capable of durably receiving the shock of a closing, heavy gate, that does not transfer all of the gate momentum to a post or gate support via nails or screws, that is easily installed, and that is inexpensive to manufacture and ship.

SUMMARY OF THE INVENTION

The problems above discussed can be solved by an improved gate stop comprising (1) a flat plate having a forward first section, a central second section, and a rear third section with each section extending the entire width of said plate; that is, extending from the upper boundary of the plate to its lowe boundary; (2) a narrow slit through the plate following a path beginning at the junction of said second and said third sections near the lower boundary of the plate, extending toward said first section, then upwardly toward the upper boundary of said plate and then back toward said third section and terminating at the junction of said second and said third sections near the upper boundary to form a flap defined by said slit which projects outwardly in the same plane from said third section when said third section is bent perpendicular to said second section; and (3) a weakened area at the junction of said first section and said second section to allow said first section to be bent perpendicular to said second section. The gate stop may be attached to a rectangular column, eg. post or gate support, by attaching the third section to a first side of the column such that the junction of the third section and the second section is at the corner of the first side and a second side of the column. The second section is then bent perpendicular to the third section so that it is flush with the second side of the column. The first section is then bent perpendicular to the second section around another corner of the rectangular column to a third side so that the first section is flush with the third side.

The gate stop of this invention avoids the problems of the prior act. For example, the flap extending from the third section of the plate absorbs the shock of the closing gate. This shock is transferred through the plate directly to the post or gate support. By wrapping the plate around three sides of the post or gate support, the transfer of momentum through the connecting nails or screws is almost entirely avoided. Thus, the gate stop of this invention represents a significant improvement over the prior act.

DETAILED DESCRIPTION OF THE INVENTION

Figure 1:
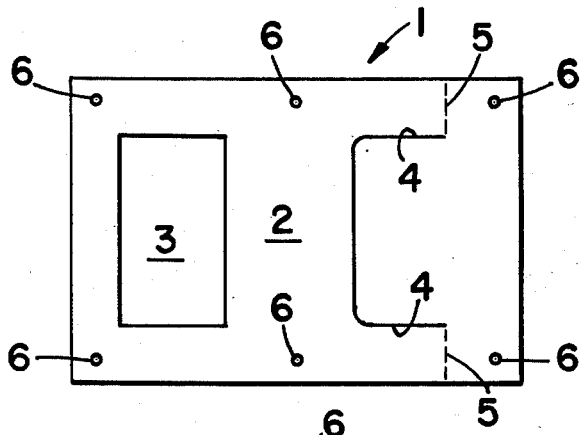
FIG. 1 is a frontal view of the gate stop of this invention.
Figure 2:
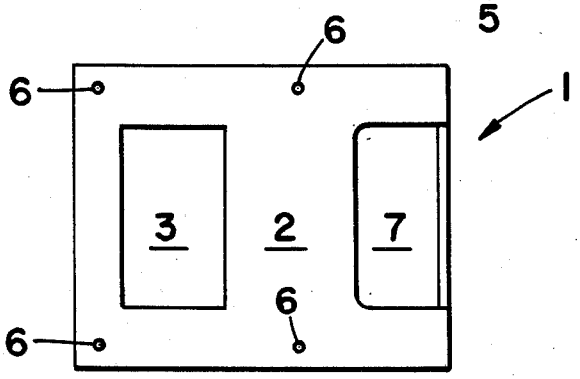
FIG. 2 is a frontal view of the gate stop of this invention with the third section bent perpendicular to the plane of the plate.
Figure 3:
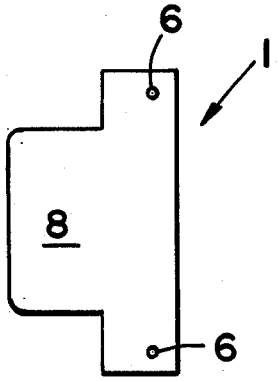
FIG. 3 is an end view of the gate stop shown in FIG. 2.
Figure 4:
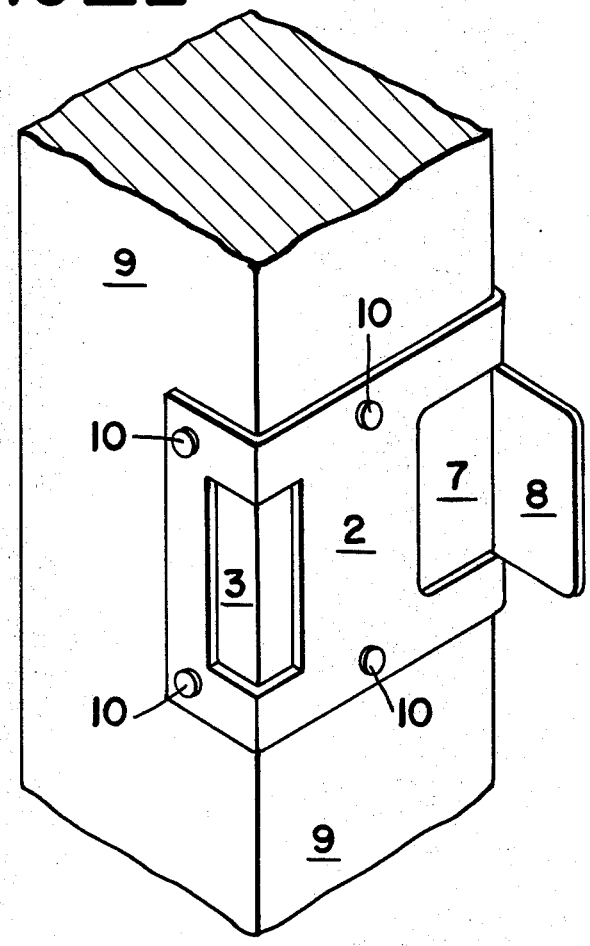
FIG. 4 is a perspective view of the gate stop of this invention attached to a rectangular column.

When references are made to the accompanying drawing, the similar characters of reference represent corresponding parts in each of the several views. Gate stop 1 is comprised of flat plate 2 which can have any convenient shape. For example, the plate may be rectangular, circular, semi-sircular, triangular, hexagonal, etc. The preferred shape is rectangular, and more preferably, rectangular with the length being from 1 to 5 times the plate's width, and more preferably, from 1.2 to 3times its width.

As shown in the drawing in one embodiment of this invention, the flat plate 2 is rectangular. The plate is divided into three fictitious sections, each section extending the full width of the plate, i.e., extending from the upper boundary of the plate to its lower boundary. The first section is located at a forward position on said plate, the second section is centrally located, and the third section is located at the rear of the plate. Each of the sections are contiguous with the next section, i.e. the first section is contiguous with the second section which is contiguous with the third section.

A narrow slit 4 is cut through the thickness of the plate and begins at the junction 5 of the third section and the second section near the bottom edge or boundary of the plate. The slit 4 extends toward the first section, then upwardly toward the upper edge or boundary of the plate, and then back towards the third section, terminating at the junction 5 of the third section and the second section near the upper edge or boundary of the plate.

The narrow slit forms a flap 8 which projects outwardly from the third section when the third section is bent perpendicular to the second section, thereby leaving a cavity 7 in the second section.

A weakened area such as rectangular hole 3 is provided at the junction of the first section and the second secton. This weakened area is provided to permit the first section of plate 2 to be bent perpendicular to the second section for attachment to one side of column 9 as illustrated in FIG. 10. The plate 2 is attached to columm 9 by nails 10 which pass through perforations 6.

The three sections of the plate are fictitious in that no physical separation of the sections is necessary. The sections merely represent that portion of the plte which may be bent perpendicular to the next section. When installed on a rectangular column, the first section will contact one side of the column, the second section will contact another side, and the third section will fit against a third side of the column. Thus, the plate will fit tightly around three sides of the four-sided post. The first section and third section will normally be smaller in length than the second section. Preferably, the first section has a length from 0.1 to 0.3 times the length of the plate, and more preferably, from 0.15 to 0.25 times the length of the plate. Likewise, the third section will preferably have a length from 0.1 to 0.3 times the length of the plate, and more preferably, from 0.15 to 0.25 times the plate's length. In addition to size, the first section may have a different shape than the second or third sections. For example, the third and second sections may be rectangular and the first section may be triangular, semi-circular, etc., or may be rectangular with a different width. The same thing applies to the second and third sections.

The plate is preferably constructed from a durable, rigid material which can be bent into place, and when installed, absorbs the shock of the closing gate. Exemplary materials which may be employed include metallics such as iron, iron alloys such as steel, etc., stainless steel, aluminum, brass and plastics or combinations thereof. Since these gate stops will be exposed to the environment, the surface of the plate is preferably treated so as to prevent rusting. Treatments include paints, zinc coatings, galvanizing, etc.

The slit is cut completely through the flat plate, and its path forms the boundary of the flap. The slit's path may be U-shaped as shwon in the drawing, or may follow any other path so long as it extends towards the first section at some point, then upwardly toward the top, and then back towards the junction of the second and third sections near the upper boundary of the plate. The slit begins at the junction near the lower boundary and ends at the junction near the upper boundary. The distance from the upper or lower boundary of the plate to the slit is not critical. Preferably, the distance is from 0.1 to 0.4, and more preferably, from 0.2 to 0.3 times the width of the plate. The width of the flap should be from 0.3 to 0.8 times the width of the plate. The slit should preferably be cut only from the central section. The length of the flap (length being the distance from the junction of the third and second sections to the farthest point toward the first section) should preferably be from 0.05 to 0.5, and more preferably, from 0.1 to 0.4 times the length of the plate.

The flap forms the striker plate for the gate stopper and must be sufficiently rigid to absorb the momentum of the gate over repeated usage. The flap may be reinforced by increasing the thickness of the flap or any portion thereof. In one embodiment, at least one corrugation, i.e. ridge or the like, is made in the flap extending from some point in the flap into the first section. This corrugation will assist the flap in resisting bending when the momentum of the gate is transferred into the gate stop.

The weakened area at the junction of the first section and the second section allows the first section to be easily bent perpendicular to the second section for easy installation on the post or gate support. The weakened area may be long score lines across the width (from the upper boundary to the lower boundary). A plurality of score lines would permit the use of the gate stop on various sizes of posts and gate supports. A preferred weakened area is a rectangular hole having its sides parallel to the sides of the plate. In a particularly perferred embodiment, the rectangular hole has an area from 0.05 to 0.3 times the area of the plate, and more preferably, from 0.1 to 0.2 times the area of the plate.

The first and third sections are preferably perforated so that nails or screws may be used to connect the gate stop to the post or gate support. The second section may likewise be perforated.

To install the gate stop on a rectangular column, eg. post or gate support, the third section of the flat plate is held flush against one side of the column with the junction of the third section and second section aligned with a corner of the column. Nails or screws are then driven through the perforations to secure the third section firmly to the column side. The first and second sections are then bent perpendicular to the third section so that the second section is flush agaist the adjacent side of the column. When the first and second sections are forced around the column corner, the flap does not bend around the corner and remains in the same plane as the first section. This results in the flap extending outwardly from the corner of the column. The second section is then secured to the column by nails, screws or the like. The junction of the first and second sections is located at another corner of the column. As such, the first section is bent perpendicular to the second section and around the corner to be flush with another side of the rectangular column. The first section is then secured to this side of the column by nails, screws or the like.

Although the invention has been described in some detail, by way of illustration and example, it should be understood that many changes and modifications may be performed within the spirit of the invention, and such are within the scope of the invention as defined by the appended claims.

I claim:

1. A gate stop comprising:

1. a flat plate having on the face of the plate a forward first section, a central second section, and a rear third section, each of said sections extending from the upper boundary of said plate to the lower boundary;
2. a narrow slit through the face of said plate following a path beginning at the junction of said second and said third sections near said lower boundary, extending toward said first section, then upwardly toward said upper boundary and then toward said third section, and terminating at the junction of said second and said third sections near said upper boundary to form a flap defined by said slit which projects outwardly in the same plane from said third section when said third section is bent perpendicular to said second section; and
3. a weakened area at the junction of said first section and said second section to allow said first section to be bent perpendicular to said second section.

2. The gate stop defined in claim 1 wherein said flat plate is rectangular.

3. The gate stop defined in claim 2 wherein said first and said third sections are perforated to allow connecting means to penetrate the flat plate for attachment to a gate post.

4. The gate stop defined in claim 2 wherein said weakened area is a rectangular hole with the sides of the rectangular hole being substantially parallel to the sides of said plate.

5. The gate stop defined in claim 2 wherein said narrow slit extends towards said first section parallel to said lower boundary, upwardly parallel to the ends of said plate and towards said third section parallel to the upper boundary to form a substantially rectangular flap when said third section is bent perpendicular to said second section.

6. The gate stop defined in claim 2 wherein said plate is a metallic plate.

7. A gate stop comprising:

1. a flat rigid rectangular plate having on the face of the plate a first forward section, a second central section, and a third rear section, and having an upper and a lower boundary.
2. a narrow slit following a path beginning at the junction of said second and said third sections near said lower boundary extending (a) substantially parallel to said lower boundary toward said first section, (b) then upward parallel to the ends of said plate, and then (c) toward said third section parallel to the upper boundary of said plate, and terminating at the junction of said second and said third sections near said upper boundary to provide a flap defined by said slit which projects outwardly from said third section when said third section is bent perpendicular to said second section; and
3. a weakened area at the junction of said first and said second sections to allow said first section to be bent perpendicular to said second section.

8. The gate stop defined in claim 7 wherein said third section has a length form 0.1 to 0.3 times the length of the rectangular plate.

9. The gate stop defined in claim 7 wherein said weakened area is a rectangular hole with the sides of the rectangular hole being parallel to the sides of said rectangular plate.

10. The gate stop defined in claim 9 wherein the area of said rectangular hole is form 0.05 to 0.3 times the area of the rectangular plate.

11. In combination:

A. an elongated column having a rectangular cross-sectional area;

B. a flat rectangular plate having a first section connected to a first side of said column, a second section perpendicular to said first section and connected to a second side of said column adjacent said fist side and a third section perpendicular to said second section extending in the same direction as said first section and connected to a third side of said column opposite said first side, a flap parallel to said third section extending outwardly from the junction of aid third section and said second section; and wherein said flap is formed (1) by a long narrow slit through said second section beginning at the junction of said third and said second sections near the lower boundary of said plate extending through said second section along a path forming said flap and terminating at the junction of said third and said second sections near the upper boundary of said plate and (2) by bending said second section perpendicular to said third section thereby forcing the flap to extend outwardly from said third section.

* * * * *